United States Patent [19]

Nored

[11] 4,208,143

[45] Jun. 17, 1980

[54] EMBOSSED SEAL MARKING DEVICE

[76] Inventor: Alvin Nored, 201 S. Pierce St., Burnet, Tex. 78611

[21] Appl. No.: 893,504

[22] Filed: Apr. 4, 1978

[51] Int. Cl.[2] ..... B43K 23/00; B65D 41/18; B65D 85/28

[52] U.S. Cl. ..... 401/98; 118/76; 132/83 G; 206/229; 220/94 A; 220/339; 401/6; 427/11

[58] Field of Search ..... 401/49, 88, 207, 126, 401/128, 130, 261, 266, 264, 118, 98, 6; 427/11; 206/229; 118/76; 132/83; 220/94 A, 375, 339

[56] References Cited

U.S. PATENT DOCUMENTS

| | | | |
|---|---|---|---|
| 448,197 | 3/1891 | Beutelspacher | 401/266 |
| 581,694 | 5/1897 | Cole | 401/207 |
| 1,501,745 | 7/1924 | Carroll | 401/49 |
| 2,332,223 | 10/1943 | Hasselquist | 401/87 |
| 2,687,157 | 8/1954 | Cowan | 220/339 |
| 3,025,184 | 3/1962 | Blair | 427/11 |
| 3,096,535 | 7/1963 | Martin | 401/118 X |
| 3,332,429 | 7/1967 | Bates | 401/98 |
| 3,545,873 | 12/1970 | Isaf | 401/98 |
| 3,860,348 | 1/1975 | Doyle | 401/6 |

FOREIGN PATENT DOCUMENTS

| | | | |
|---|---|---|---|
| 1363570 | 5/1964 | France | 401/130 |
| 502644 | 12/1954 | Italy | 220/339 |
| 380299 | 9/1964 | Switzerland | 220/339 |
| 229269 | 7/1925 | United Kingdom | 427/11 |

OTHER PUBLICATIONS

The Magic Eye, Tricks Every Boy Can Do, Todd, 1948, p. 20, New York, Hart Pub. Co.

*Primary Examiner*—Clyde I. Coughenour
*Attorney, Agent, or Firm*—Cox & Smith Incorporated

[57] ABSTRACT

An embossed seal marking device having a rigid, non-resilient marking member secured with a handle for rubbing the marking member on the raised portions of the embossed seal to transfer marking material to the raised portions to make the seal visible for photocopying and having a cover member for covering the marking member.

1 Claim, 5 Drawing Figures

EMBOSSED SEAL MARKING DEVICE

BACKGROUND OF THE INVENTION

This invention relates generally to a new and improved device for marking notarial and other embossed seals so that they will be visible when copied by electrostatic photocopying machine.

It has been known for many years that it is often desirable to mark the raised portion of an embossed seal for purposes of photocopying. Numerous attempts have been made to solve this problem. In particular, one such specific device as shown in U.S. Pat. No. 3,279,359 issued to J. W. Meyer on Oct. 18, 1966. This device discloses a cylindrical marker having a pad formed of a porous thermoplastic resin commonly referred to as "spun plastic" which defines a micro-reticulated structure. The material is of a spongy nature and has a multiplicity of inner-connected minute capillary pores throughout the same opening on a working plane or face. The material possesses only a slight degree of resistance to initial compressive forces and when released the material will immediately become restored to its original form. The pad is impregnated with a suitable ink or coloring liquid, substantially filling all of the interstices or microscopic spaces within the pad. To prevent the inking pad from contacting the non-raised portion of the embossed seal when it is used, a spacer means is included projecting downwardly below the plane of the inking pad surface at the periphery thereof for contacting with the surface of a piece of paper around the embossed seal when the pad engages the raised portion of the embossed seal for marking the same. Additional patents of which Applicant is aware are U.S. Pat. Nos. 3,154,010, 3,626,844, and 3,522,769.

The above-described devices so far as known suffer from several defects and Applicant is not aware that any of the devices have been marketed. In particular, it is believed that the above markers are costly to manufacture which has inhibited their coming on the market. The marking device shown in U.S. Pat. No. 3,279,359 requires the use of ink or other liquid coloring which may tend to dry out if left uncovered resulting in a short useful life. Also, any marker using ink may leak, which could result in the possibility of ruining valuable documents. Also, smearing can result from using any type of ink marker and in the case of permanent inks cannot be corrected by erasing.

There has been a long-felt need for a marking device for embossed seals since electrostatic photocopying has become so prevalent, particularly in legal documents. So far as known, numerous attempts have been made to fulfill this need. In particular, it is known that attempts have been made to use an ordinary pencil lead to apply the "lead" to the raised portion of the embossed seal to make it visible when photocopied. Another type of known device is a block of carbon black material which can be used to transfer the carbon black to the raised portion of the embossed seal. So far as known, no one has yet provided a device which would satisfactorily fill the need for making embossed seals visible for photocopying.

SUMMARY OF THE INVENTION

A new and improved embossed seal marking device which utilizes a cylindrical member of marking material having a flat planar marking surface for contacting with the raised portions of an embossed seal. The marking seal is formed of "lead" of the type used in ordinary pencils and having a medium hardness. The marking material is mounted with a handle member to facilitate sliding of the marking material over the embossed portions of the seal to transfer the "lead" to the raised portions of the embossed seal to make them visible for photocopying. A cover is provided which cover is secured with the handle, so that when the cover is in place, it completely covers the marking material.

The proposed marker is long-lasting, of very low cost and the marking may be erased if it is undesirable for the marking to be permanently left on the embossed seal. The marker requires no maintenance such as the addition of ink and the possibilities of smearing are virtually eliminated. There is no waiting period for any ink to dry and the marking device is complete in itself, since no ink supply need be kept. The marking device can also be used without any cap or cover without the risk of drying out or damaging any documents or getting ink on the user. The marking device can also be rotated on the raised portion of an embossed seal which allows the marking of the entire seal which may not be possible with inking devices. The marking device will also mark a seal having only slightly raised lettering without ruining the document in case the erasable marking occurs on the surface of the document. This eliminates the need for a spacer means which may prevent the marking of lightly embossed seals. Of particular importance is that the marking material is non-yielding so that it is less likely to mark parts of the document other than the raised portions during use. Also, it requires virtually no skill or care in using the marking device, since any mistake can be easily corrected or erased without any damage at all to the document being copied.

DESCRIPTION OF THE PREFERRED EMBODIMENT

Figure 1:
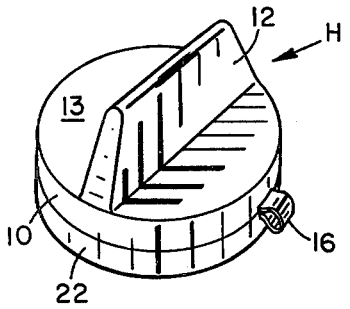
FIG. 1 is a perspective view of the embossed seal marking device of the invention.
Figure 2:
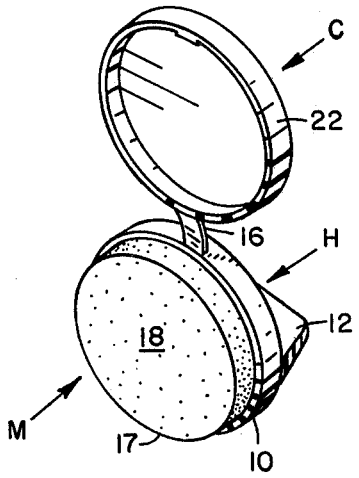
FIG. 2 is another perspective view of the embossed seal marking device of the invention with the cover open to reveal the marking material.
Figure 3:
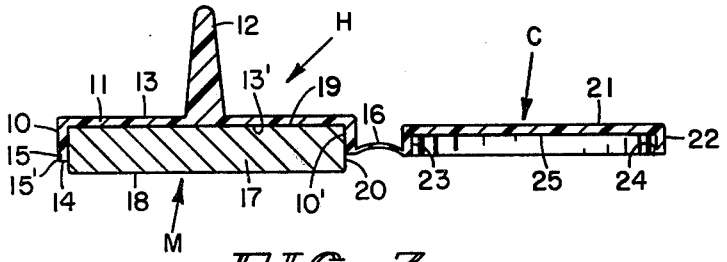
FIG. 3 is a cross-sectional view of the embossed seal marking device of the invention.
Figure 5:
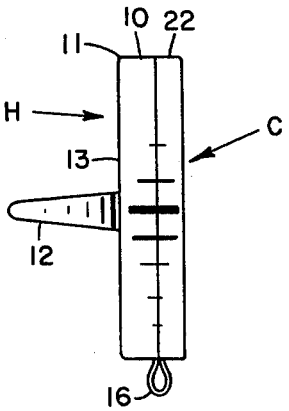
FIG. 5 is a side view of the embossed seal marking device.

Referring to FIGS. 1 and 2 of the drawings, there is shown the embossed seal marking device of the invention. In particular, the embossed seal marking device includes a handle member H to which is mounted a marking member M. A cover C is mounted with the handle H for covering the marking member M as shown in FIGS. 1 and 5.

More particularly, the handle member H includes a cylindrically shaped wall portion 10 which is integrally formed with a top portion 11. A hand grip 12 is also integrally formed on the upper surface 13 under the top portion 11. The handle member H further includes an extension tab 14 integrally formed with the cylindrically shaped wall 10 which extension tab 14 includes a locking groove 15 which provides a catch 15' which function is explained more fully hereinafter. Opposite the extension tab 14 is a hinge member 16 which connects the cover member with the marking member.

The marking member M includes a generally cylindrical disc 17 of marking material which in the preferred embodiment is formed of rigid, nonresilient marking "lead" of the type used in carbon rods or pencils and which has a medium hardness. The marking material may include a suitable coloring pigment in a known binder to form a rigid non-resiliant disc. The marking material is erasable so that a document is not permanently damaged if any marking material gets on the non-raised portions of the seal. It is contemplated that other rigid, non-resilient marking materials which are erasable might be substituted for the carbon or lead. The cylindrical disc of marking material 17 includes a flat planar marking surface 18 which is used to mark the embossed or raised portions of a seal. The cylindrical disc 17 further includes a generally flat surface 19 which matches with the lower surface 13' of the top portion 11 of the handle member. The cylindrical wall surface 20 is sized to fit tightly within the cylindrically shaped wall 10 and preferably tightly engages the inner cylindrical surface 10' of the cylindrically shaped wall member 10. A suitable adhesive may be applied to the surfaces 19 and 13' to secure the cylindrical disc with the handle member H.

Figure 4:
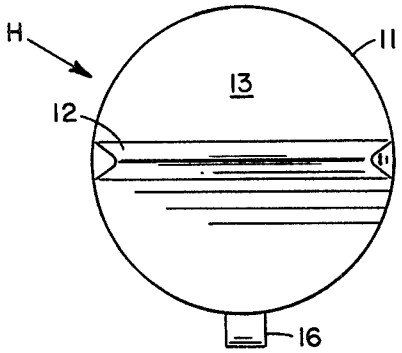
FIG. 4 is a top view of the embossed seal marking device.

The cover member C is preferably cylindrical and includes a bottom wall member 21 that is integrally formed with a cylindrically shaped wall 22. The inner cylindrical surface 23 of the cylindrical wall member 20 has substantially the same diameter as the inner wall surface 10' of the wall member 10 so as to fit over the cylindrical wall member 20 of the cylindrical disc 17. A groove 24 is formed in the inner surface 23 opposite where the hinge member 16 secures the handle member and cover member together, which groove 24 fits over the catch 15' formed by the groove 15. When in its latched position the cover member appears as shown in FIGS. 1, 4 and 5.

The cover member and handle member are preferably formed of thermoplastic material using injection molding or the like, and preferably are formed of non-rigid material so that the hinge member 16 may be formed with the handle member and cover member in one step. The hardness of the cylindrical disc 17 of marking material is designed to ease the application of "lead" onto the embossed portion of the seal. Since it is generally not desirable to apply undue pressure to the embossed portions of the seal, a medium hardness is believed to be the best. It is contemplated that the "lead" material having a hardness HB may be utilized for the marking material.

While there has been shown and described a preferred embodiment of an embossed seal marking device in accordance with the invention, it will be appreciated that many changes and modification may be made therein without, however, departing from the essential spirit of the invention within the scope of the claims.

I claim:

1. An embossed seal marking device for marking the raised portions of the seal to make the seal visible for photocopying, comprising:

a handle means having a cylindrically shaped wall portion which is integrally formed with a circular top portion and a hand grip integrally formed on the upper surface of the top portion;

said handle means including an extension tab integrally formed with the cylindrically shaped wall portion and having a locking groove which provides a catch;

a hinge member integrally formed with the cylindrically shaped wall portion opposite the extension tab and connected with a cylindrically shaped cover member having a catch opposite the hinge member for latching with the locking groove of the extension tab;

a marking member formed of marking material which is erasable secured with said handle means;

said marking member being in the shape of a disc having a flat planar marking surface and formed of a rigid, non-resilient marking material and having a hardness such that rubbing engagement of the flat planar marking surface with the raised portions of the seal will transfer some of the marking material to the raised portions of the embossed seal to make the seal visible for photocopying;

said marking member having a circular periphery defining the perimeter of the flat planar marking surface; and the handle member is secured with the marking member opposite the marking surface and cylindrically shaped wall portion does not extend below the marking surface providing no spacing of the marking surface above the non-emobossed portions of the seal so that the marking surface will engage slightly raised portions of the seal without any interference; and the said marking material is a carbon composition in a suitable binder to form a rigid non-resilient marking material.

* * * * *